US012050026B2

(12) United States Patent
Perlin et al.

(10) Patent No.: US 12,050,026 B2
(45) Date of Patent: Jul. 30, 2024

(54) METHOD AND APPARATUS FOR PRODUCING A CLEAN AIR CURTAIN

(71) Applicants: Kenneth Perlin, New York, NY (US); Andre Fenton, New York City, NY (US)

(72) Inventors: Kenneth Perlin, New York, NY (US); Andre Fenton, New York City, NY (US)

( * ) Notice: Subject to any disclaimer, the term of this patent is extended or adjusted under 35 U.S.C. 154(b) by 212 days.

(21) Appl. No.: 17/562,375

(22) Filed: Dec. 27, 2021

(65) Prior Publication Data

US 2022/0205657 A1 Jun. 30, 2022

Related U.S. Application Data

(60) Provisional application No. 63/131,245, filed on Dec. 28, 2020.

(51) Int. Cl.
*F24F 9/00* (2006.01)
*F24F 8/108* (2021.01)
*F24F 140/00* (2018.01)

(52) U.S. Cl.
CPC ..... *F24F 9/00* (2013.01); *F24F 8/108* (2021.01); *F24F 2009/002* (2013.01); *F24F 2140/00* (2018.01); *F24F 2221/28* (2013.01)

(58) Field of Classification Search
CPC ..... F24F 9/00; F24F 2009/002; F24F 2009/2007; F24F 8/10; F24F 3/16
USPC ..... 454/188
See application file for complete search history.

(56) References Cited

U.S. PATENT DOCUMENTS 2,507,634 A * 5/1950 Hill ..... F24F 13/0604 454/231
4,339,250 A * 7/1982 Thut ..... B01D 46/2411 454/231
5,133,788 A * 7/1992 Backus ..... F24F 8/158 55/467
5,264,015 A * 11/1993 Matsui ..... F24F 1/0071 55/467

(Continued)

FOREIGN PATENT DOCUMENTS

CA 2655553 A1 * 12/2007 ..... B60H 3/0007
CN 104949213 A * 9/2015 ..... B01D 46/0002

(Continued)

*Primary Examiner* — Edelmira Bosques
*Assistant Examiner* — Frances F. Hamilton
(74) *Attorney, Agent, or Firm* — Ansel M. Schwartz

(57) ABSTRACT

An apparatus for producing a clean air curtain to protect a first individual and a second individual from germ transfer between themselves has a housing having an input port and an output port. The apparatus comprises a fan disposed in the housing in communication with the input port to draw air into an input channel through the input port, and in communication with the output port through an output channel to force air from the input channel through the output channel and out the output port. The output channel configured to cause the air forced out the output port to create a laminar flow air curtain. The apparatus has an air filter positioned across the input channel to clean the air drawn through the input port. A method for protecting a first individual and a second individual from germ transfer between themselves with an air curtain.

8 Claims, 5 Drawing Sheets

(56) References Cited

U.S. PATENT DOCUMENTS

| | | | | |
|---|---|---|---|---|
| 6,217,437 | B1 * | 4/2001 | Murray | A01K 1/031 119/500 |
| 2004/0241054 | A1 * | 12/2004 | Yuen | B03C 3/017 422/121 |
| 2007/0202798 | A1 * | 8/2007 | Billiotte | F24F 7/007 454/264 |
| 2013/0243588 | A1 * | 9/2013 | Lo | F24F 8/108 415/182.1 |
| 2015/0064069 | A1 * | 3/2015 | Yi | A61L 9/20 422/121 |
| 2018/0328605 | A1 * | 11/2018 | Bae | F24F 8/10 |
| 2021/0003301 | A1 * | 1/2021 | Takayanagi | F24F 9/00 |
| 2022/0010988 | A1 * | 1/2022 | Cash | F24F 3/16 |
| 2022/0120459 | A1 * | 4/2022 | Bemis | F24F 1/0022 |
| 2024/0017199 | A1 * | 1/2024 | Lee | F24F 8/10 |

FOREIGN PATENT DOCUMENTS

| | | | | | |
|---|---|---|---|---|---|
| CN | 108036430 | A | * | 5/2018 | |
| CN | 108592290 | A | * | 9/2018 | F24F 13/072 |
| CN | 115111687 | A | * | 9/2022 | |
| GB | 2415879 | A | * | 1/2006 | A61L 9/20 |
| JP | H0910528 | A | * | 1/1997 | |
| JP | H0921553 | A | * | 1/1997 | |
| JP | 5238758 | B2 | * | 7/2013 | |
| JP | 2022064362 | A | * | 4/2022 | |

* cited by examiner

METHOD AND APPARATUS FOR PRODUCING A CLEAN AIR CURTAIN

CROSS-REFERENCE TO RELATED APPLICATIONS

This is a nonprovisional of U.S. provisional patent application Ser. No. 63/131,245 filed Dec. 28, 2020, incorporated by reference herein.

FIELD OF THE INVENTION

The present invention is related to producing a clean air curtain to protect a healthy person from being infected by an infectious person whom the healthy person is physically meeting for a conversation. (As used herein, references to the "present invention" or "invention" relate to exemplary embodiments and not necessarily to every embodiment encompassed by the appended claims.) More specifically, the present invention is related to producing a clean air curtain to protect a healthy person from being infected by an infectious person whom the healthy person is physically meeting for a conversation by placing an apparatus with a fan which creates a laminar flow air curtain between the healthy person and the infectious person.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

When individuals are infectious or potentially infectious but asymptomatic—for example, with the common cold, or more extremely, as during the COVID-19 pandemic—they nonetheless want to be able to sit across a table from each other without masks to have a chat over a drink or a cup of coffee. While such conversational social activity is fundamental and enormously valuable for exchanging and building ideas, it is nonetheless, currently not safe indoors, due to COVID-19. Because as each person speaks, they spray from their mouth small droplets of water which may contain SARS-CoV-2, the COVID-19 virus. If the droplets from a COVID-19 positive person are inhaled by the person on the other side of the table, the virus can spread.

BRIEF SUMMARY OF THE INVENTION

People want to gather in person indoors—whether at home or in a restaurant or coffee shop—and they want to have a conversation across a table without needing to wear a mask. What is described herein is an apparatus that can be placed in the center of a table which reduces airborne transmission of the COVID-19 virus between two or more conversationalists across a table who are not wearing masks.

The present invention combines the functionality of an air purifier and a laminar flow air curtain. The novel utility of this combined functionality is that it removes SARS-CoV-2 and other contaminants from the air while simultaneously preventing COVID-19 bearing airborne droplets from traveling across a table from one person seated at the table to another person sitting across the table.

The present invention pertains to an apparatus for producing a clean air curtain to protect a first individual and a second individual from germ transfer between themselves. The apparatus comprises a housing having an input port and an output port. The apparatus comprises a fan disposed in the housing and below and in fluidic communication with the input port through an input channel to draw air into the input channel through the input port, and in fluidic communication with the output port through an output channel to force air from the input channel through the output channel and out the output port. The output channel configured to cause the air forced out the output port to create a laminar flow air curtain. The apparatus comprises a HEPA compliant air filter positioned adjacent to the input port and across the input channel to clean the air drawn through the input port.

The present invention pertains to a method for protecting a first individual and a second individual from germ transfer between themselves with an air curtain. The method comprises the steps of placing a housing between the first individual and the second individual. The housing has an input port and an output port. The housing has a fan disposed in the housing and below and in fluidic communication with the input port through an input channel to draw air into the input channel through the input port, and in fluidic communication with the output port through an output channel to force air from the input channel through the output channel and out the output port. The output channel configured to cause the air forced out the output port to create a laminar flow air curtain. The housing has a HEPA compliant air filter positioned adjacent the input port and across the input channel to clean the air drawn through the input port. There is the step of turning on the fan on to create the laminar flow air curtain between the first individual and the second individual.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
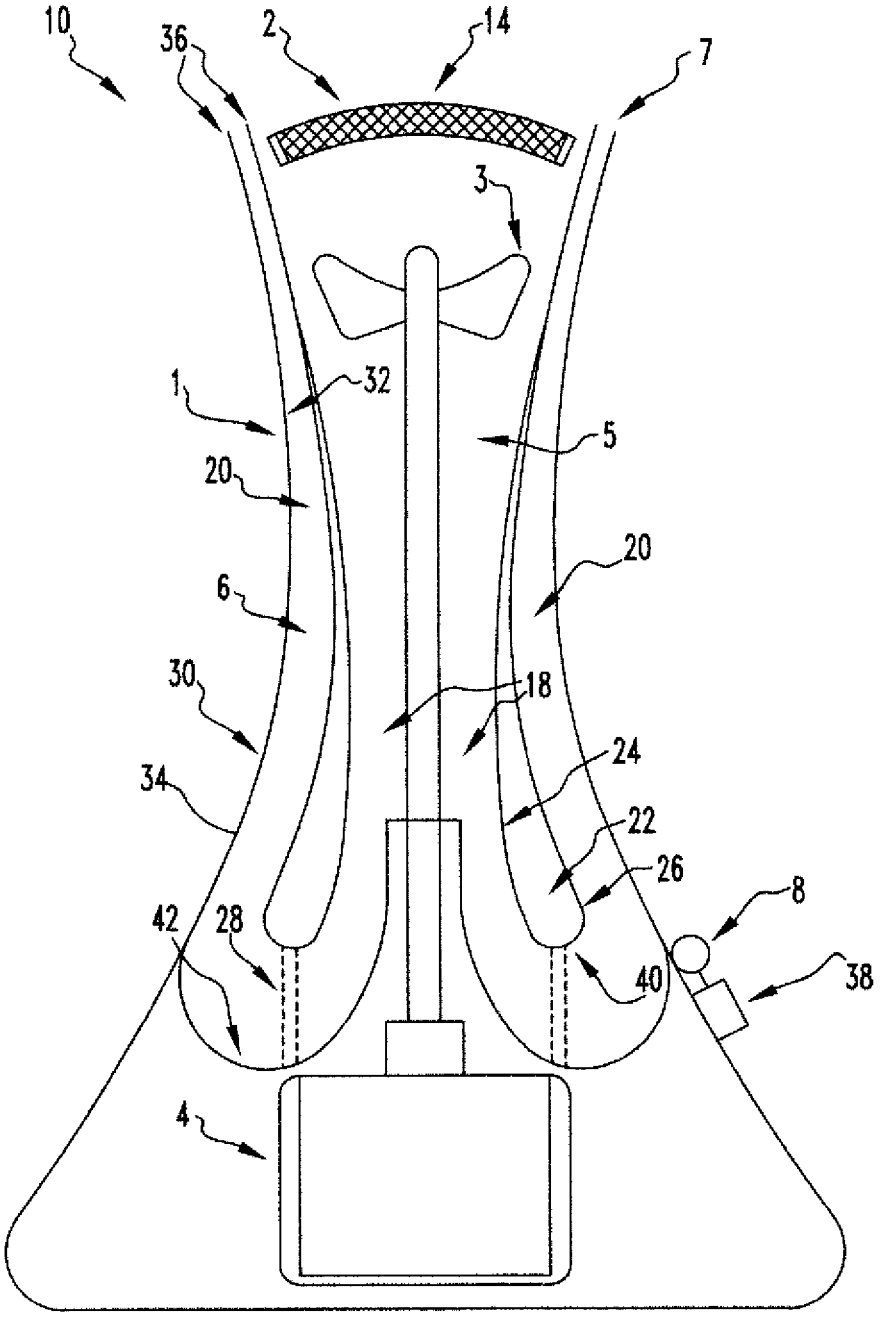
FIG. 1 shows cross-section of an apparatus of the present invention.

Referring now to the drawings wherein like reference numerals refer to similar or identical parts throughout the several views, and more specifically to FIGS. 1, 3, 4 and 5 thereof, there is shown an apparatus 10 for producing a clean air curtain 12 to protect a first individual and a second individual from germ transfer between themselves. The apparatus 10 comprises a housing 1 having an input port 14 and an output port 7. The apparatus 10 comprises a fan 3 disposed in the housing 1 and below and in fluidic communication with the input port 14 through an input channel 18 to draw air into the input channel 18 through the input port 14, and in fluidic communication with the output port 7 through an output channel 20 to force air from the input channel 18 through the output channel 20 and out the output port 7. The output channel 20 configured to cause the air forced out the output port 7 to create a laminar flow air curtain 12. The apparatus 10 comprises a HEPA compliant air filter 2 positioned adjacent to the input port 14 and across the input channel 18 to clean the air drawn through the input port 14.

The housing 1 may have an outer chamber 6 through which the output channel 20 extends. The housing 1 may have a central chamber 5 through which the input channel 18 extends. The outer chamber 6 positioned about the central chamber 5 but separate and fluidically isolated from the central chamber 5. The fan 3 disposed in the central chamber 5. The housing 1 may have an inner wall 22 having an interior surface 24 and an outside surface 26 disposed between the outer chamber 6 and the central chamber 5. The interior surface 24 of the inner wall 22 defining a shape of the central chamber 5. Small stubs 28 of plastic may extend up from a bottom of the housing 1 to a bottom 40 of the interior wall to support the interior wall. The stubs 28 are spaced apart to allow the air to flow between them from the central chamber 5 to the outer chamber 6.

The housing 1 may have an outer wall 30 having an inside surface 32 and an exterior surface 34 disposed about the outer chamber 6. The inside surface 32 and the outside surface 26 defining a shape of the outer chamber 6 and the output channel 20. The inside surface 32 and the outside surface 26 may be structured so that the output channel 20 gradually narrows as the air flows upwards toward the output port 7 and along the inside surface 32 and the outside surface 26 due to a Coandă effect. The inner chamber and the outer chamber 6 may have a shape of an annulus.

The inside surface 32 and the outside surface 26 may gradually curve inwards and then outwards as the air flows upwards towards the output port 7 having an s shape so a circular wall of air in a state of annular flow increases in radius as the air continues to flow upwards after leaving the output port 7. A top of the inner wall 22 and the outer wall 30 each may have an edge lip 36 which angles downwards at least 30 degrees so there is no applicable Coandă effect at a location where the air emerges from the output port 7. The edge lip 36 of the inner and outer wall together define the output port 7.

The apparatus 10 may include a sensor 38 in communication with the filter 2 and an indicator 8 in contact with the housing 1 and in communication with the sensor 38 which indicates when the filter 2 needs to be replaced. The apparatus 10 may include a motor 4 disposed in the base of the housing 1 and connected to the fan 3 which rotates the fan 3. A bottom 40 of the inner wall 22 may have a parabolic or rounded shape and a bottom 42 of the inside surface 32 has a parabolic or rounded shape.

The present invention pertains to a method for protecting a first individual and a second individual from germ transfer between themselves with an air curtain 12. The method comprises the steps of placing a housing 1 between the first individual and the second individual. The housing 1 has an input port 14 and an output port 7. The housing 1 has a fan 3 disposed in the housing 1 and below and in fluidic communication with the input port 14 through an input channel 18 to draw air into the input channel 18 through the input port 14, and in fluidic communication with the output port 7 through an output channel 20 to force air from the input channel 18 through the output channel 20 and out the output port 7. The output channel 20 configured to cause the air forced out the output port 7 to create a laminar flow air curtain 12. The housing 1 has a HEPA compliant air filter 2 positioned adjacent the input port 14 and across the input channel 18 to clean the air drawn through the input port 14. There is the step of turning on the fan 3 on to create the laminar flow air curtain 12 between the first individual and the second individual.

The apparatus 10 produces a curtain 9 of air in a state of laminar flow. Airborne droplets traveling across the table are trapped in this curtain 9. The trapped air is then routed through a filter 2, which may be HEPA compliant, and thereby purified. The filter 2, which may be removable, absorbs any tiny airborne water droplets.

Because such filters require changing periodically, the apparatus 10 can also contain an indicator 8 to show when the filter 2 needs to be changed. The sensor 38 that measures when a filter 2 needs changing can make use of the fact that water gradually builds up within the filter 2, thereby decreasing its electrical resistance. When electrical resistance falls below a certain level, then the indicator 8 indicates that the filter 2 needs to be changed. Alternatively, the sensor 38 may be a pressure sensor 38 and when the pressure falls below a threshold value, then the indicator 8 indicates that the filter 2 needs to be changed.

In one version, the apparatus 10 is constructed, as shown in FIG. 1.

Components:

(1) Apparatus housing
(2) HEPA compliant filter
(3) Fan
(4) Motor
(5) Central chamber
(6) Outer annular chamber
(7) Circular slit along top
(8) Filter replacement indicator light In one embodiment, the housing 1 is injection molded as a single piece of plastic. The walls of the channel of the outer annular chamber are structured so that the air within the channel gradually narrows as the air flows upward. The upward flowing air flows along these walls due to the Coandă effect. The edge lip 36 at the top of the annular chamber falls away sharply on both the inner and outer walls 22, 30, so that there is no appreciable Coandă effect at the point where the air emerges from the top of the output port. The air therefore continues in a state of laminar flow. The walls near the top of the annular chamber (6) are tilted slightly outward, so that the circular wall of air in a state of annular flow increases in radius as it continues to flow upward after leaving the apparatus 10. Alternately, two semi-circular halves of the housing 1 can be injection molded and then glued together to create the complete housing 1.

In one embodiment, the central chamber 5 is 1" in diameter at its narrowest point, and the output port 7 is narrow circular slit along the top is 2" in diameter, and the width of the slit is 0.05". The ratio of cross-sectional area between those two regions is 1/10. In this embodiment, the downward velocity of the air at that location in the central chamber 5 may be 40 ft/min, resulting in a velocity of the laminar sheet 9 of air emerging from the circular slit shape of the output port 10 times greater, or 400 ft/min.

The apparatus 10 can provide the following functions:

1) laminar flow air updraft to block contaminated air droplets from traveling across the table;
2) downward flow through a HEPA compliant filter 2 to filter 2 out contaminants.

User Experience:

The apparatus 10 is plugged in and placed in the middle of a table. While people are sitting at the table, the apparatus 10 is switched on. When the "filter needs replacing" indicator 8 light comes on, the user replaces the removable air filter 2.

Optionally, the apparatus 10 can glow, thereby also serving as a decorative object or lamp.

Figure 2:
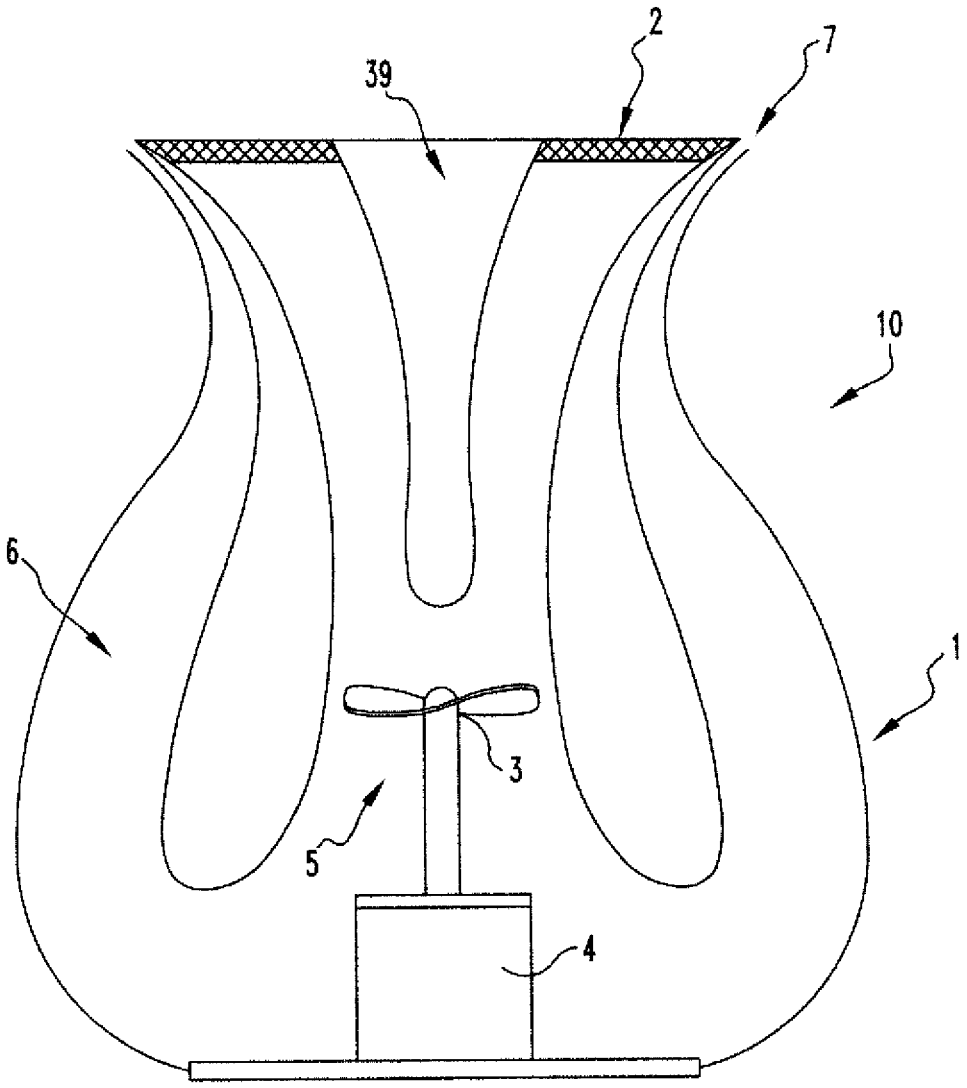
FIG. 2 shows a cross-section of an alternative embodiment of the apparatus.

Also optionally, the central chamber 5 can contain a hollow cavity 39 at the top center, open at the top. In this way, the apparatus 10 can also serve as a flower vase, as shown in FIG. 2.

Figure 3:
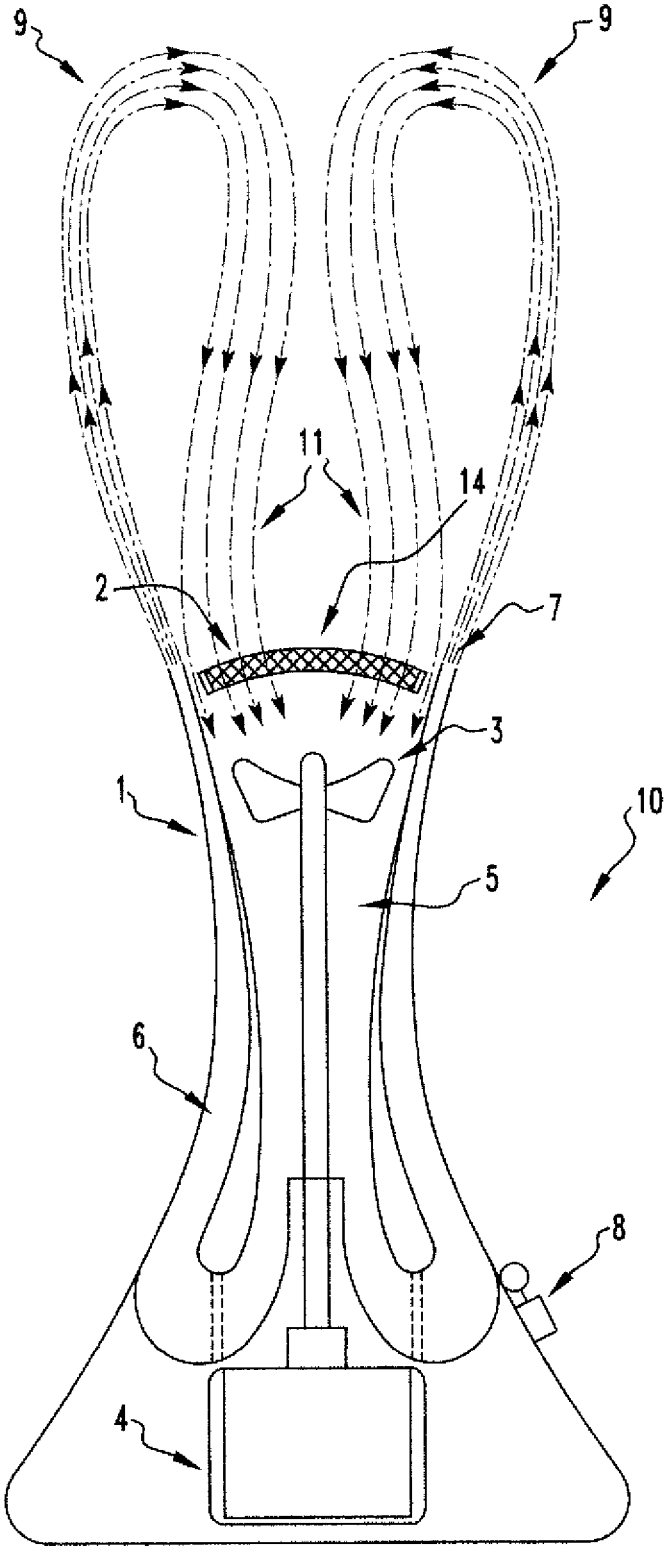
FIG. 3 shows airflow associated with the apparatus.

Internal Operation:

As shown in FIG. 3, when the apparatus 10 is switched on, the motor 4 begins to turn. Air is pulled into the top of the apparatus 10 through the HEPA compliant filter 2 by a fan 3, which is powered by the electric motor 4. As the air passes through the HEPA filter 2, contaminants remain trapped within the filter 2 and the now purified air is drawn into the central chamber 5. The purified air is then further pushed by the pressure created by the fan 3 into the outer annular chamber 6, and then forced upward and outward through the narrow circular slit shaped opening of the output port 7 at the top of the housing 1, to form a laminar sheet 9 of air, which captures any laterally moving droplets traveling across the table from one person toward another. This air is eventually sucked back downward into the center 11 where it recirculates back in through the HEPA compliant filter 2. There may be a battery in the motor 4 or in the housing 1, or there may be a power cord which extends from the motor 4 and through the housing 1 to provide electricity to the motor 4.

Figure 4:
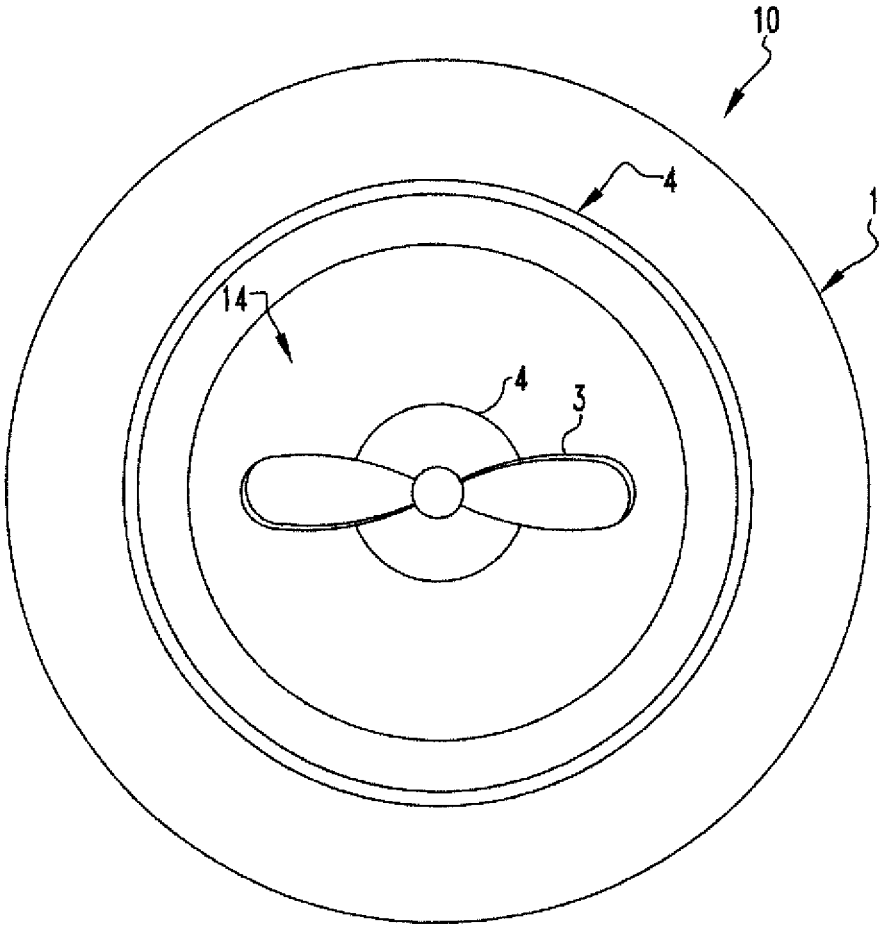
FIG. 4 shows an overhead view of the apparatus.

FIG. 4 shows an overhead view of the apparatus 10.

Figure 5:
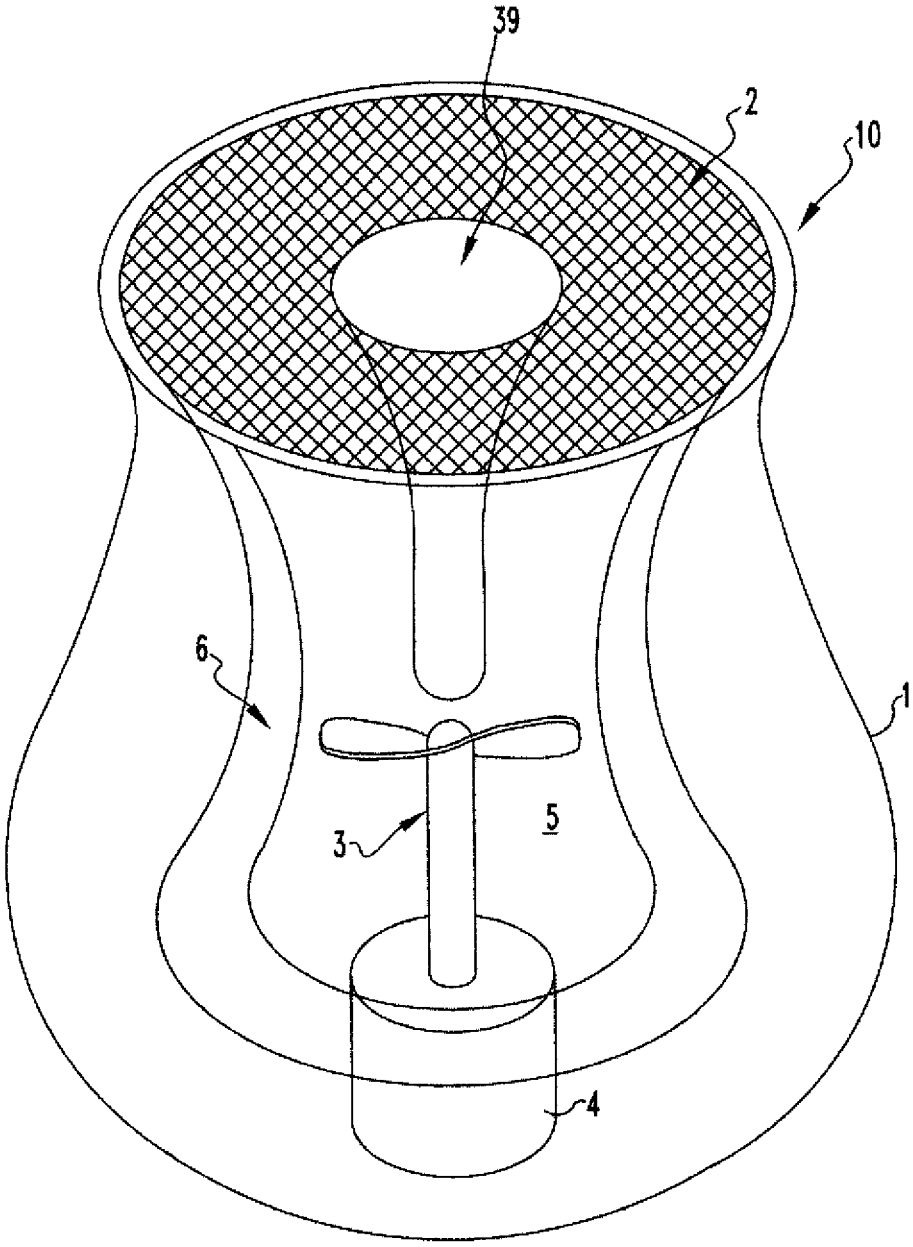
FIG. 5 is a cut away perspective view of the apparatus.

FIG. 5 is a cut away perspective view of the apparatus 10.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. An apparatus for producing a clean air curtain to protect a first individual and a second individual from germ transfer between themselves comprising:

a housing having an input port and an output port;

a fan disposed in the housing and below and in fluidic communication with the input port through an input channel to draw air into the input channel through the input port, and in fluidic communication with the output port through an output channel to force air from the input channel through the output channel and out the output port, the output channel configured to cause the air forced out the output port to create a laminar flow air curtain, the housing has an outer chamber through which the output channel extends, the housing has a central chamber through which the input channel extends, the outer chamber positioned about the central chamber but separate and fluidically isolated from the central chamber, the fan disposed in the central chamber, the housing has an inner wall having an interior surface and an outside surface disposed between the outer chamber and the central chamber, the interior surface of the inner wall defining a shape of the central chamber, the housing has an outer wall having an inside surface and an exterior surface disposed about the outer chamber, the inside surface and the outside surface defining a shape of the outer chamber and the output channel, the inside surface and the outside surface are structured so that the output channel gradually narrows as the air flows upwards toward the output port and along the inside surface and the outside surface due to a Coandă effect; and a HEPA compliant air filter positioned adjacent to the input port and across the input channel to clean the air drawn through the input port.

2. The apparatus of claim 1 wherein the inner chamber and the central chamber have a shape of an annulus.

3. The apparatus of claim 2 wherein the inside surface and the outside surface gradually curve inwards and then outwards as the air flows upwards towards the output port having an s shape so a circular wall of air in a state of annular flow increases in radius as the air continues to flow upwards after leaving the output port.

4. The apparatus of claim 3 wherein a top of the inner wall and the outer wall each have an edge lip which angles downwards at least 30 degrees so there is no applicable Coandă effect at a location where the air emerges from the output port, the edge lip of the inner and outer walls together define the output port.

5. The apparatus of claim 4 including a sensor in communication with the filter and an indicator in contact with the housing and in communication with the sensor which indicates when the filter needs to be replaced.

6. The apparatus of claim 5 including a motor disposed in the base of the housing and connected to the fan which rotates the fan.

7. The apparatus of claim 6 wherein a bottom of the inner wall has a parabolic or rounded shape and a bottom of the inside surface has a parabolic or rounded shape.

8. A method for protecting a first individual and a second individual from genii transfer between themselves with an air curtain comprising the steps of:

placing a housing between the first individual and the second individual, the housing having an input port and an output port;

a fan disposed in the housing and below and in fluidic communication with the input port through an input channel to draw air into the input channel through the input port, and in fluidic communication with the output port through an output channel to force air from the input channel through the output channel and out the output port, the output channel configured to cause the air forced out the output port to create a laminar flow air curtain, the housing has an outer chamber through which the output channel extends, the housing has a central chamber through which the input channel extends, the outer chamber positioned about the central chamber but separate and fluidically isolated from the central chamber, the fan disposed in the central chamber, the housing has an inner wall having an interior surface and an outside surface disposed between the outer chamber and the central chamber, the interior surface of the inner wall defining a shape of the central chamber, the housing has an outer wall having an inside surface and an exterior surface disposed about the outer chamber, the inside surface and the outside surface defining a shape of the outer chamber and the output channel, the inside surface and the outside surface are structured so that the output channel gradually narrows as the air flows upwards toward the output port and along the inside surface and the outside surface due to a Coandă effect; and a HEPA compliant air filter positioned adjacent the input port and across the input channel to clean the air drawn through the input port; and turning on the fan to create the laminar flow air curtain between the first individual and the second individual.

* * * * *